US007997708B2

(12) United States Patent
Chung et al.

(10) Patent No.: US 7,997,708 B2
(45) Date of Patent: Aug. 16, 2011

(54) INK-CARTRIDGE FOR PRINTERS AND INK REFILLING METHOD

(75) Inventors: Kwang-Choon Chung, Yongin-si (KR); Chang Soo Yu, Suwon-si (KR); Nam Boo Cho, Anyang-si (KR); Young Chul Shin, Suwon-si (KR); Baek Song Heo, Ansan-si (KR)

(73) Assignee: Inktec Co., Ltd., Kyeongki-do (KR)

( * ) Notice: Subject to any disclaimer, the term of this patent is extended or adjusted under 35 U.S.C. 154(b) by 735 days.

(21) Appl. No.: 12/093,823

(22) PCT Filed: Mar. 17, 2007

(86) PCT No.: PCT/KR2007/001316

§ 371 (c)(1), (2), (4) Date: May 15, 2008

(87) PCT Pub. No.: WO2007/008620

PCT Pub. Date: Sep. 27, 2007

(65) Prior Publication Data

US 2008/0278556 A1 Nov. 13, 2008

(30) Foreign Application Priority Data

Mar. 18, 2006 (KR) ..... 10-2006-0025095
Mar. 16, 2007 (KR) ..... 10-2007-0026343

(51) Int. Cl.
*B41J 2/175* (2006.01)

(52) U.S. Cl. ..... 347/87; 347/85; 347/44

(58) Field of Classification Search ..... 347/85–87, 347/44, 47

See application file for complete search history.

(56) References Cited

U.S. PATENT DOCUMENTS

| | | | | |
|---|---|---|---|---|
| 6,000,791 | A | 12/1999 | Scheffelin et al. | |
| 6,283,588 | B1 | 9/2001 | Brandon et al. | |
| 6,817,707 | B1 | 11/2004 | Fowler et al. | |
| 7,303,271 | B2 * | 12/2007 | Shimizu et al. | 347/94 |
| 7,374,271 | B2 * | 5/2008 | Umeda | 347/20 |
| 7,914,124 | B2 * | 3/2011 | Seshimo et al. | 347/66 |

(Continued)

FOREIGN PATENT DOCUMENTS

| | | | |
|---|---|---|---|
| EP | 0826505 | A2 | 3/1998 |
| EP | 0841174 | A2 | 5/1998 |
| EP | 1199178 | A1 | 4/2002 |
| JP | 2003-191489 | | 7/2003 |
| JP | 2004-203059 | | 7/2004 |

*Primary Examiner* — Ellen Kim
(74) *Attorney, Agent, or Firm* — The Webb Law Firm

(57) ABSTRACT

An ink cartridge for printers and ink filling method that can expand the space where the ink is filled, and maintain pressure inside the ink cartridge. The ink cartridge includes a body formed in a predetermined shape and having a filling hold on one surface, a filling chamber where ink is filled inside the body, a discharging chamber connected to the filling chamber, an ink discharging port connected to the discharging chamber through an ink transferring channel, an air chamber connected to the filling chamber to supply air through an air transferring channel, an air suction valve in the air chamber, an air inducing channel that induces exterior air into the air suction valve, a blocking film attached to one surface of the body, a cover installed on another surface of the body, a pressure regulating part on one surface of outer body, which communicates with the filling chamber.

8 Claims, 12 Drawing Sheets

U.S. PATENT DOCUMENTS

2002/0044182 A1* 4/2002 Hou et al. ..... 347/86
2003/0122907 A1 7/2003 Kim
2004/0100537 A1 5/2004 Lui et al.
2005/0253909 A1* 11/2005 Usui ..... 347/92
2007/0070115 A1* 3/2007 Shindo ..... 347/29
2008/0049063 A1* 2/2008 Nakamura et al. ..... 347/20
2008/0284832 A1* 11/2008 Chung et al. ..... 347/86
2009/0073245 A1* 3/2009 Chung et al. ..... 347/87

* cited by examiner

【Figure 1】
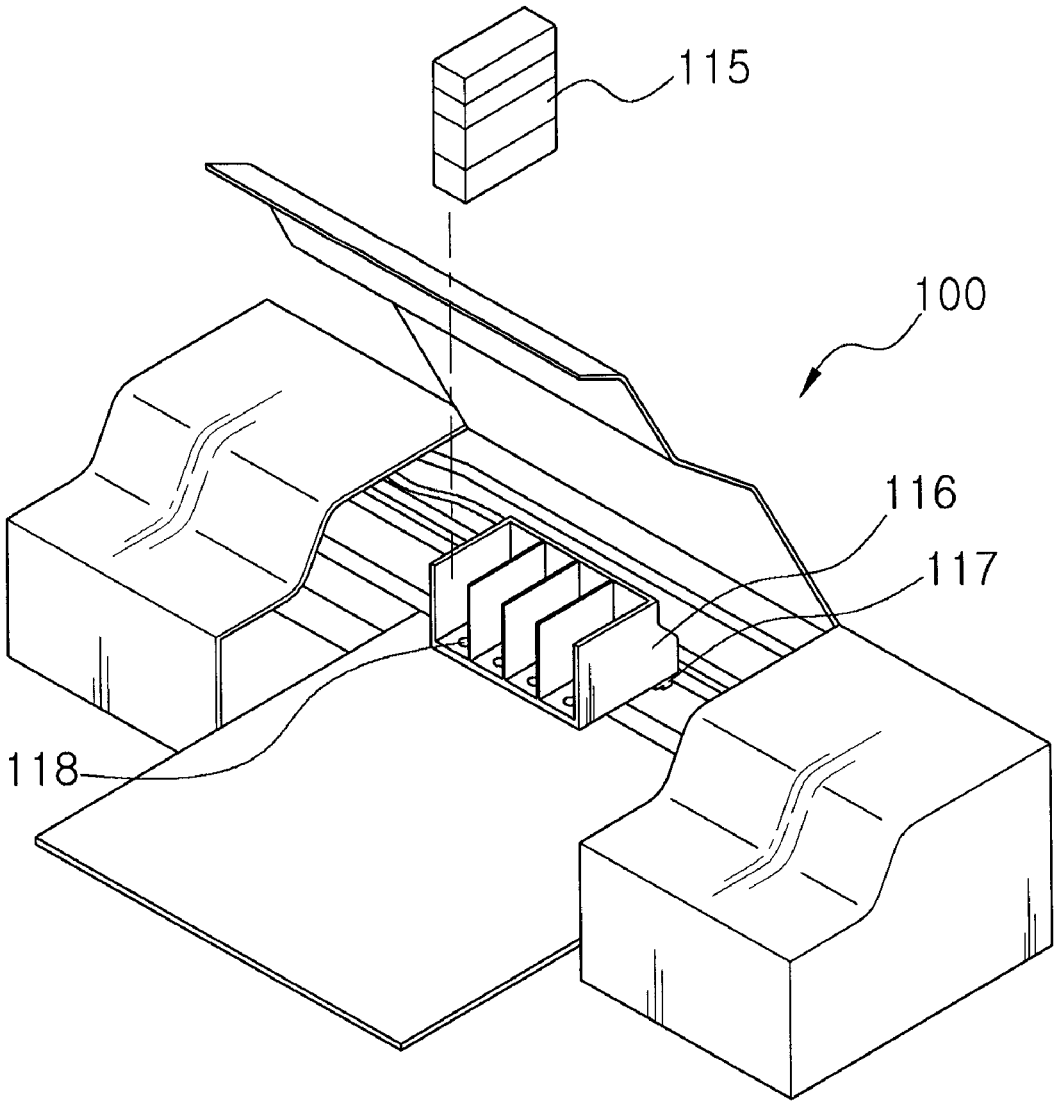

【Figure 2】
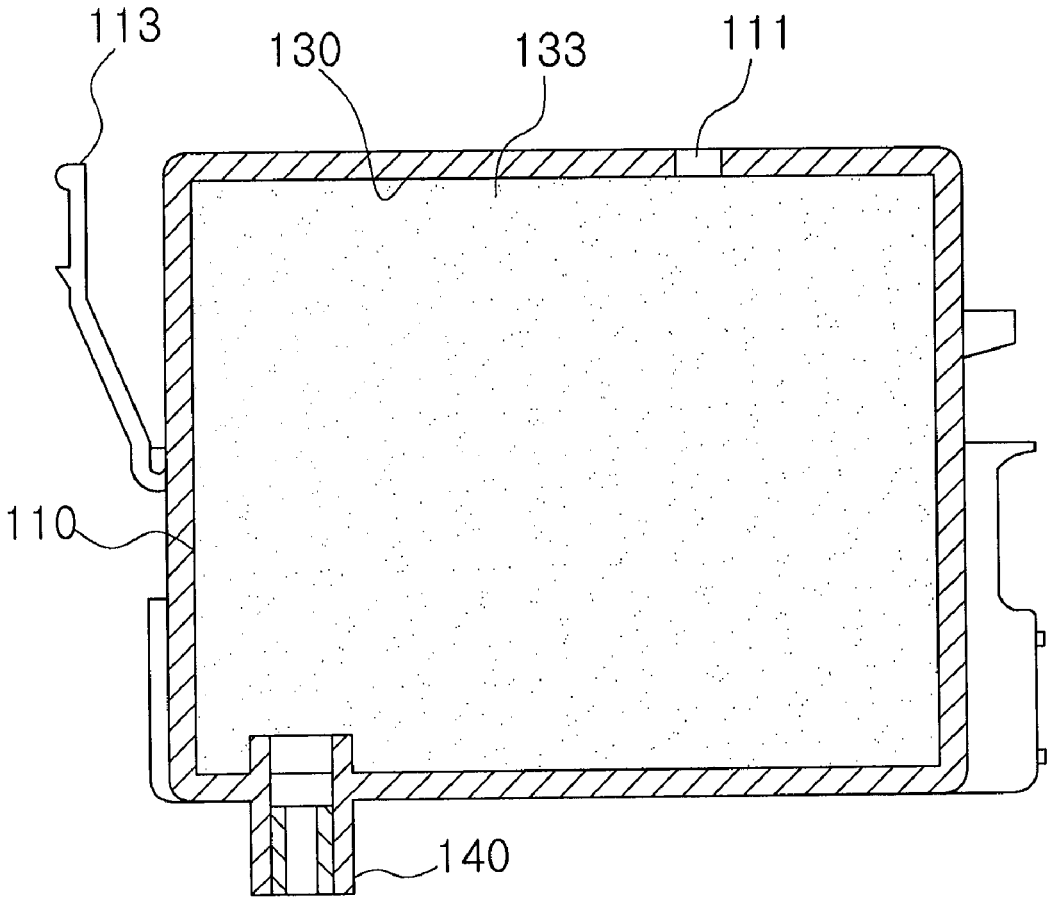

【Figure 3】
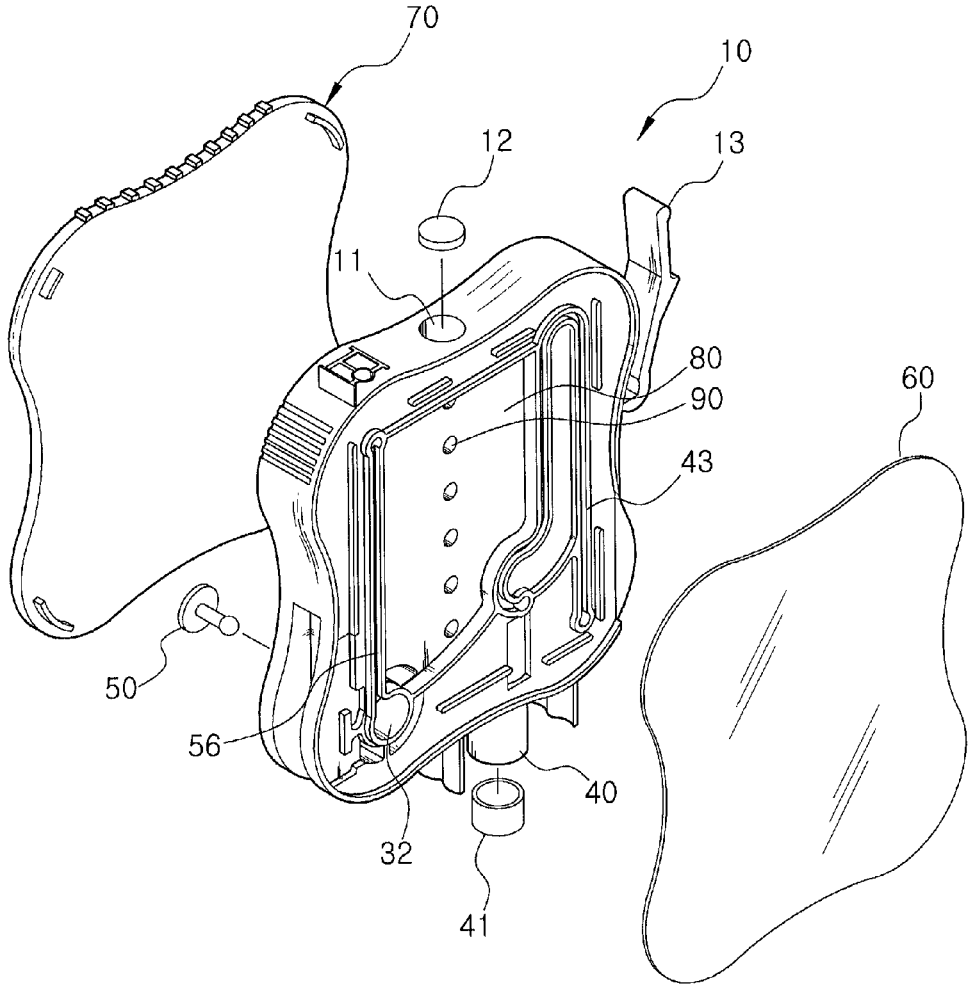

【Figure 4】
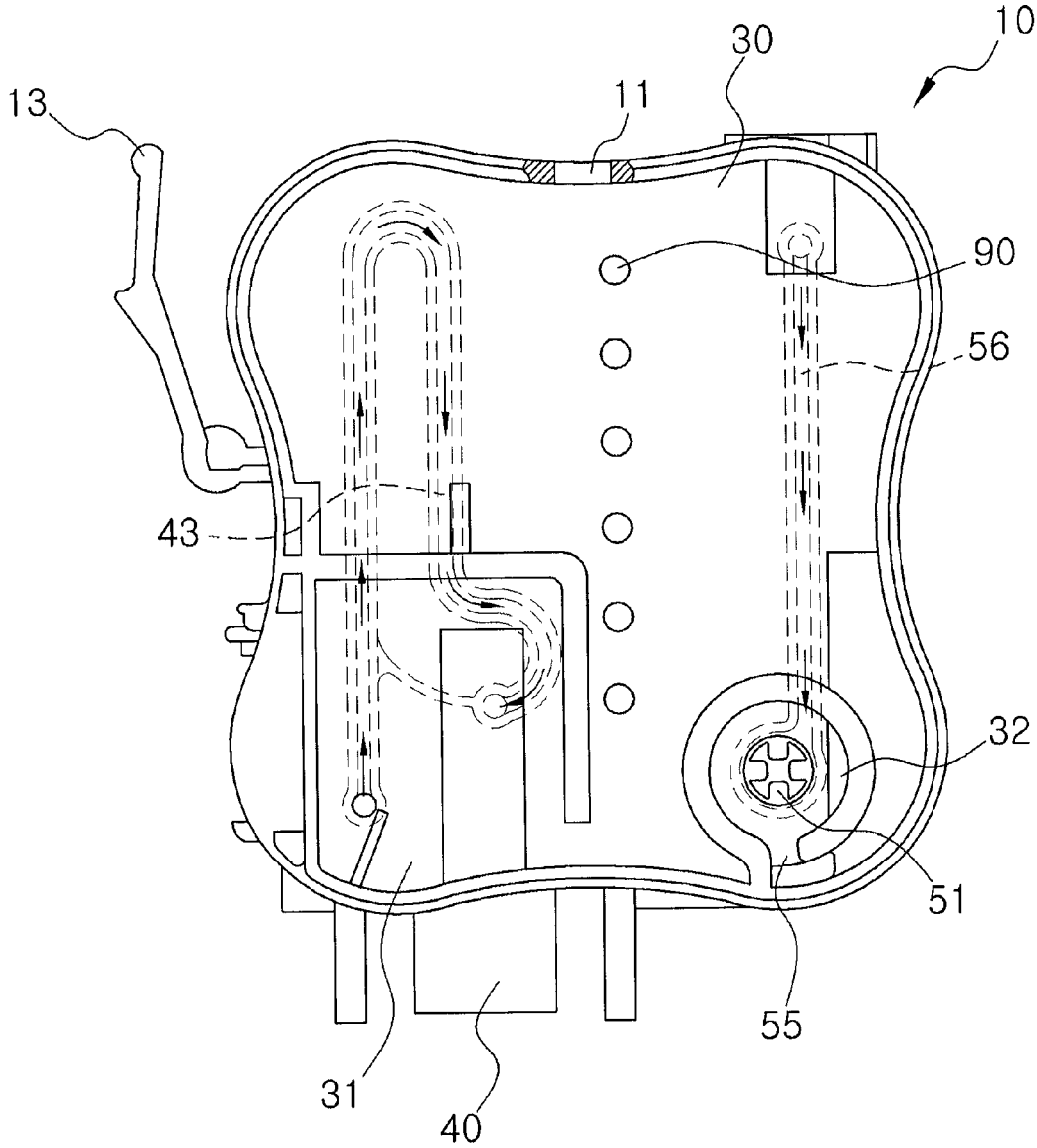

【Figure 5】
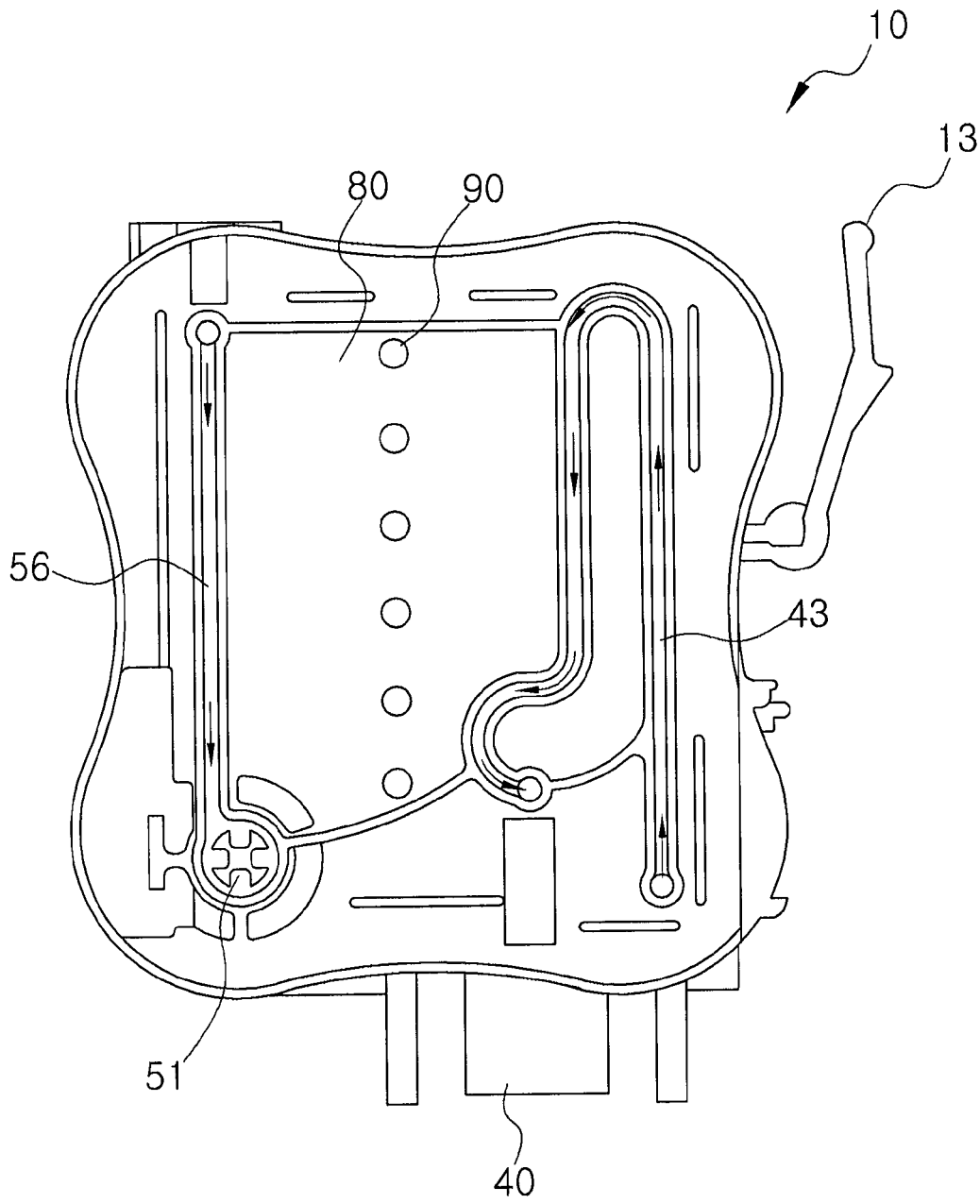

【Figure 6】
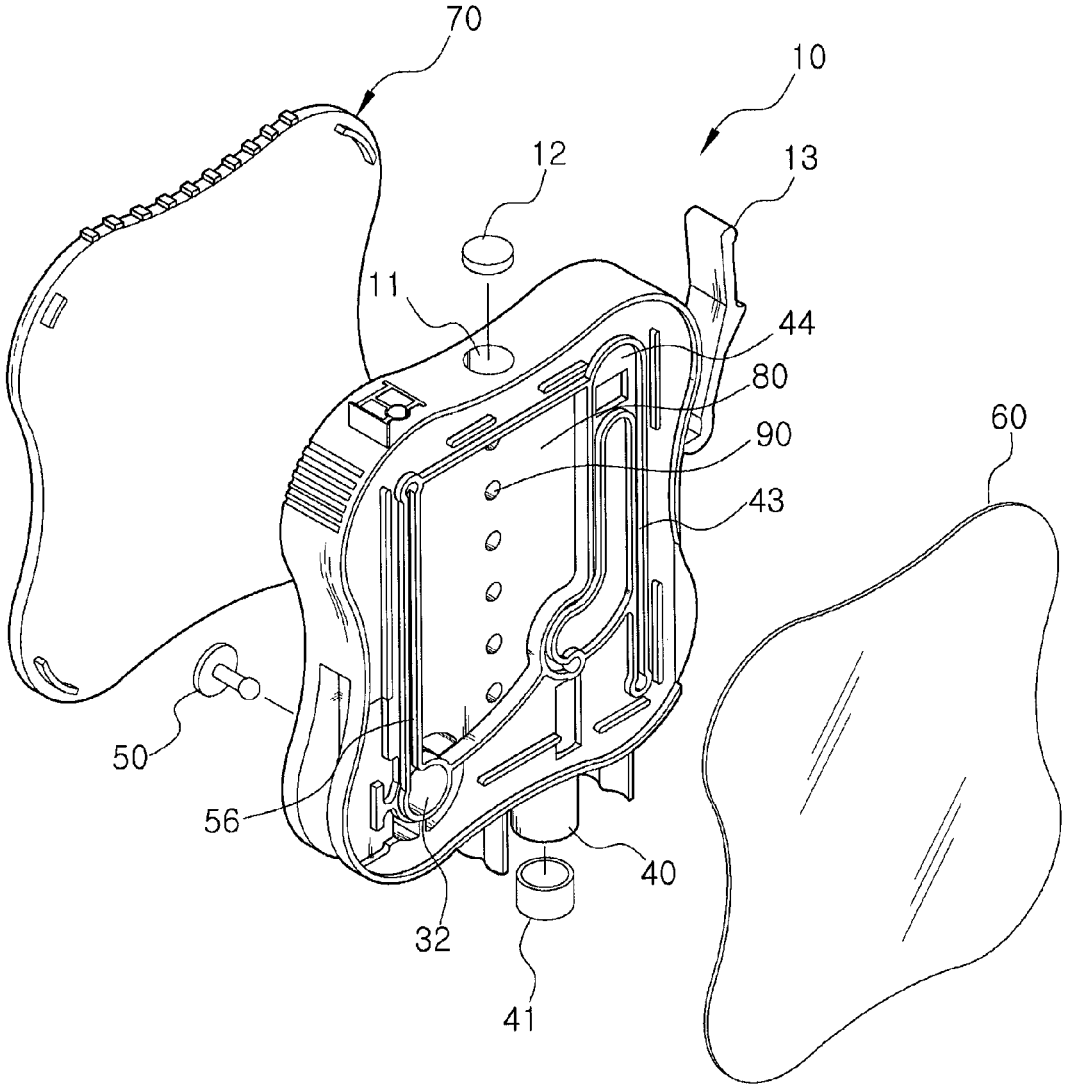

【Figure 7】
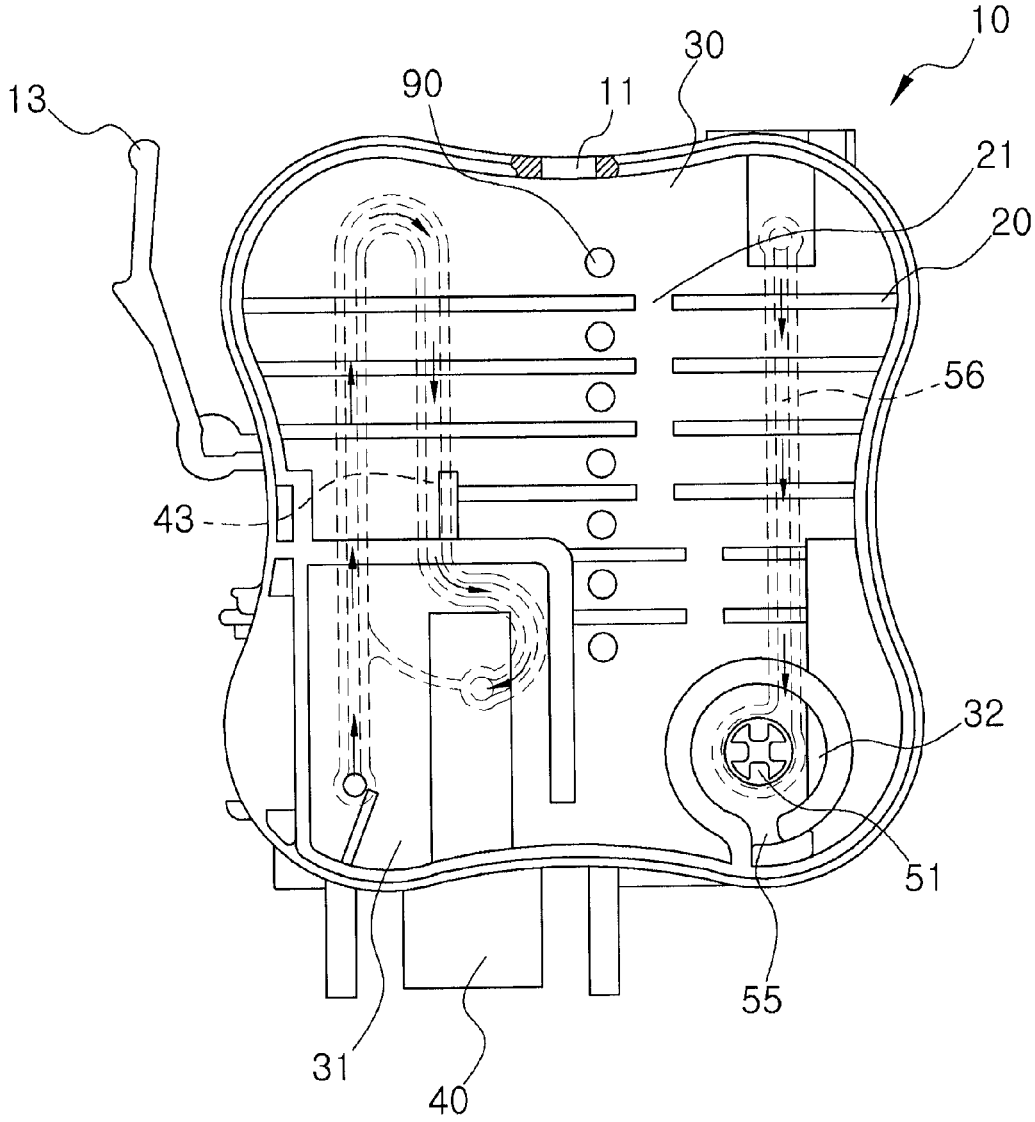

【Figure 8】
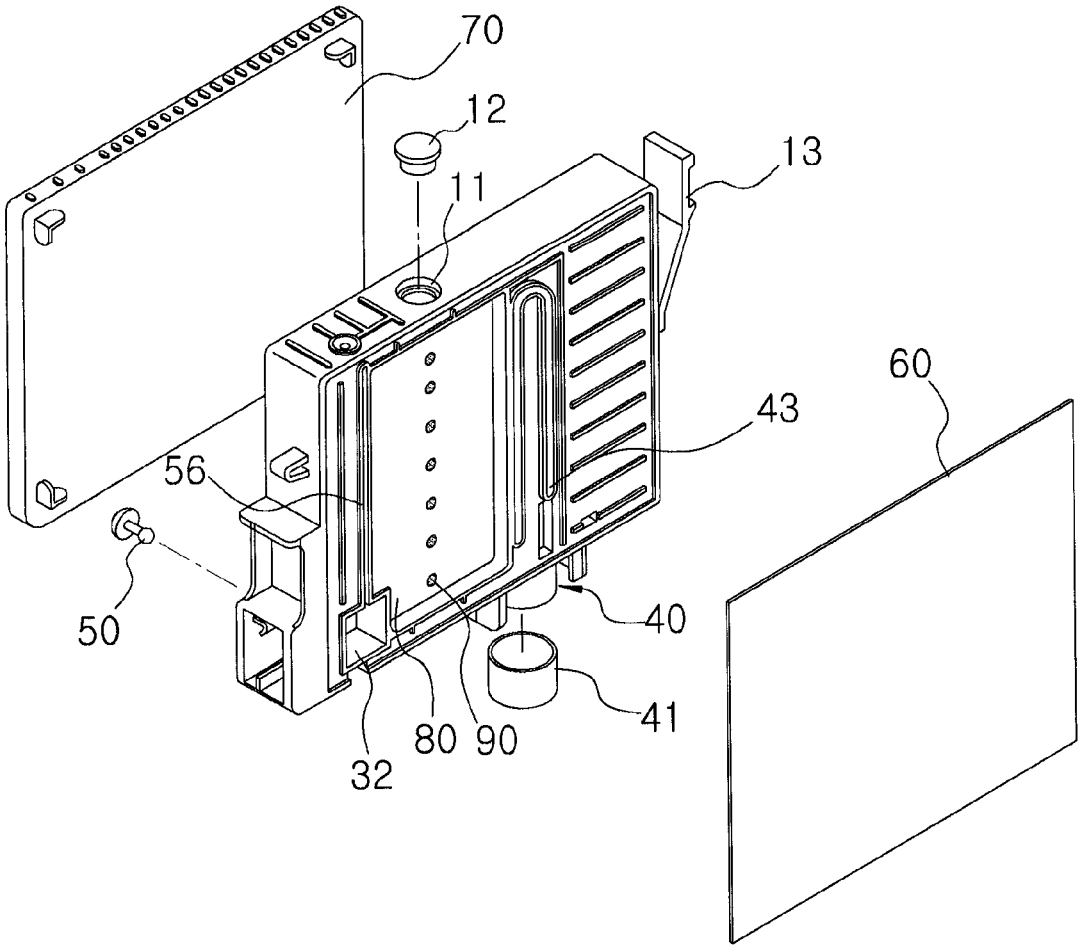

【Figure 9】
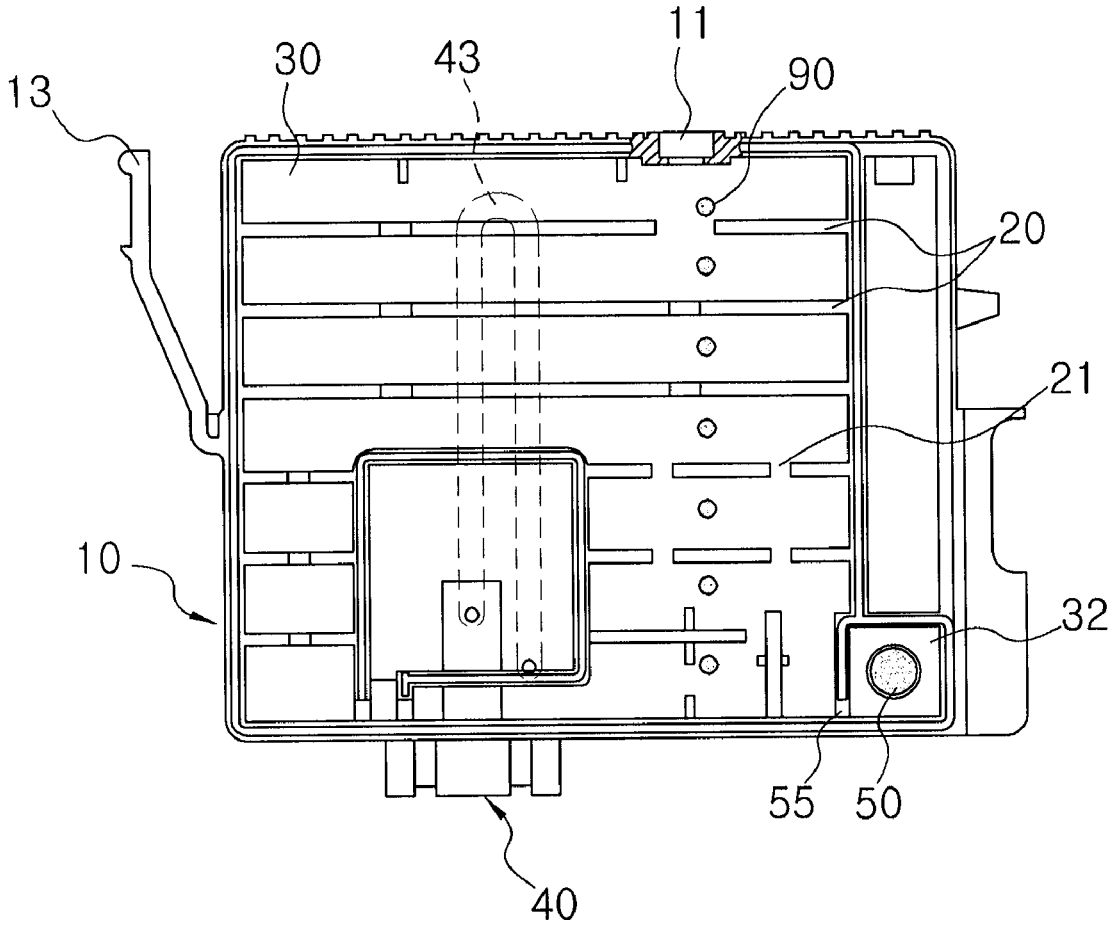

【Figure 10】
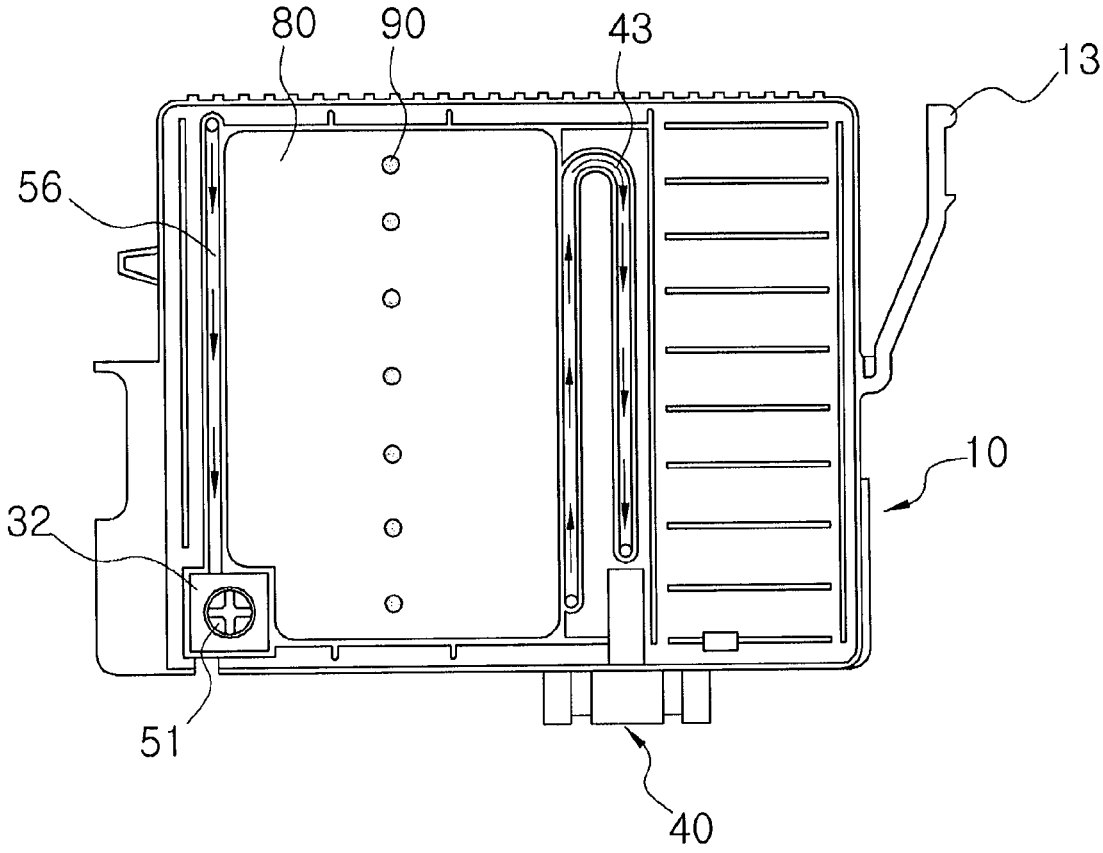

【Figure 11】
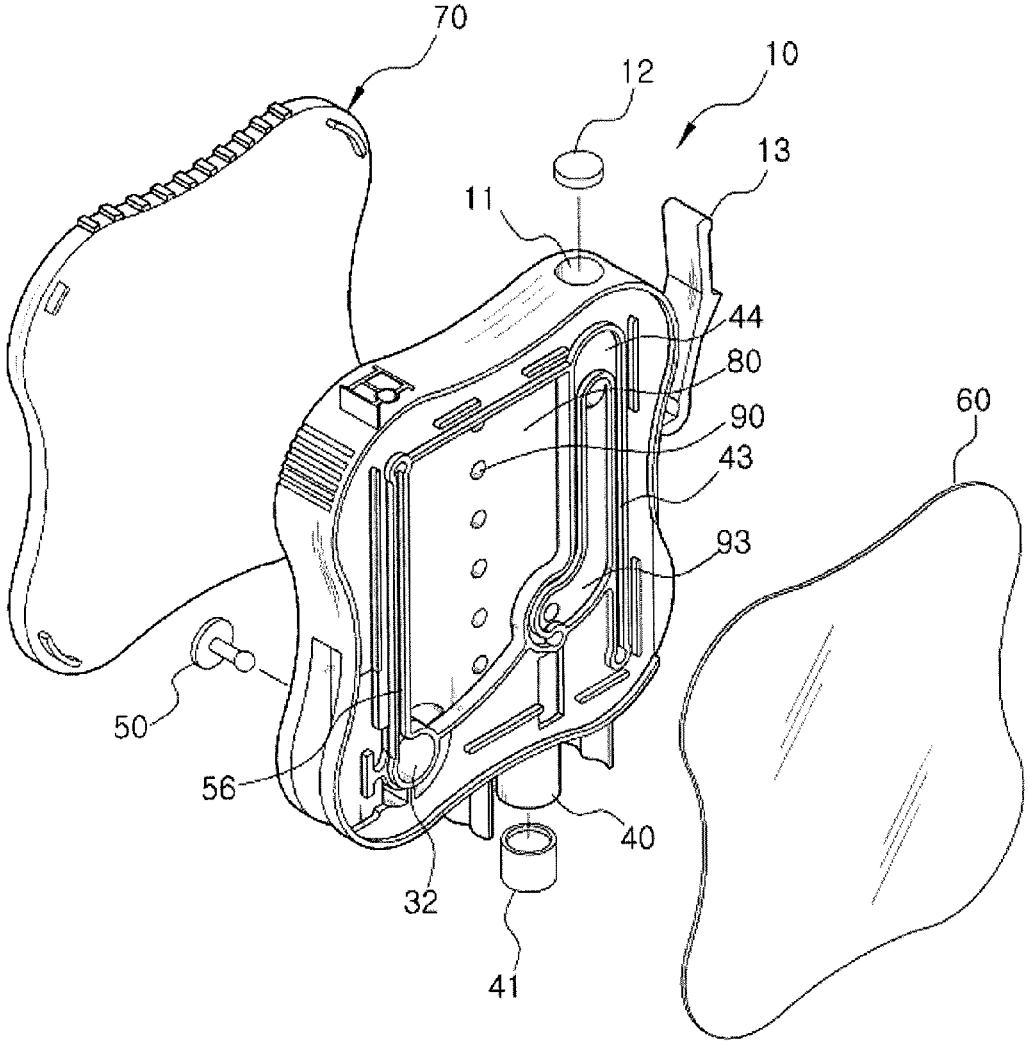

【Figure 12】
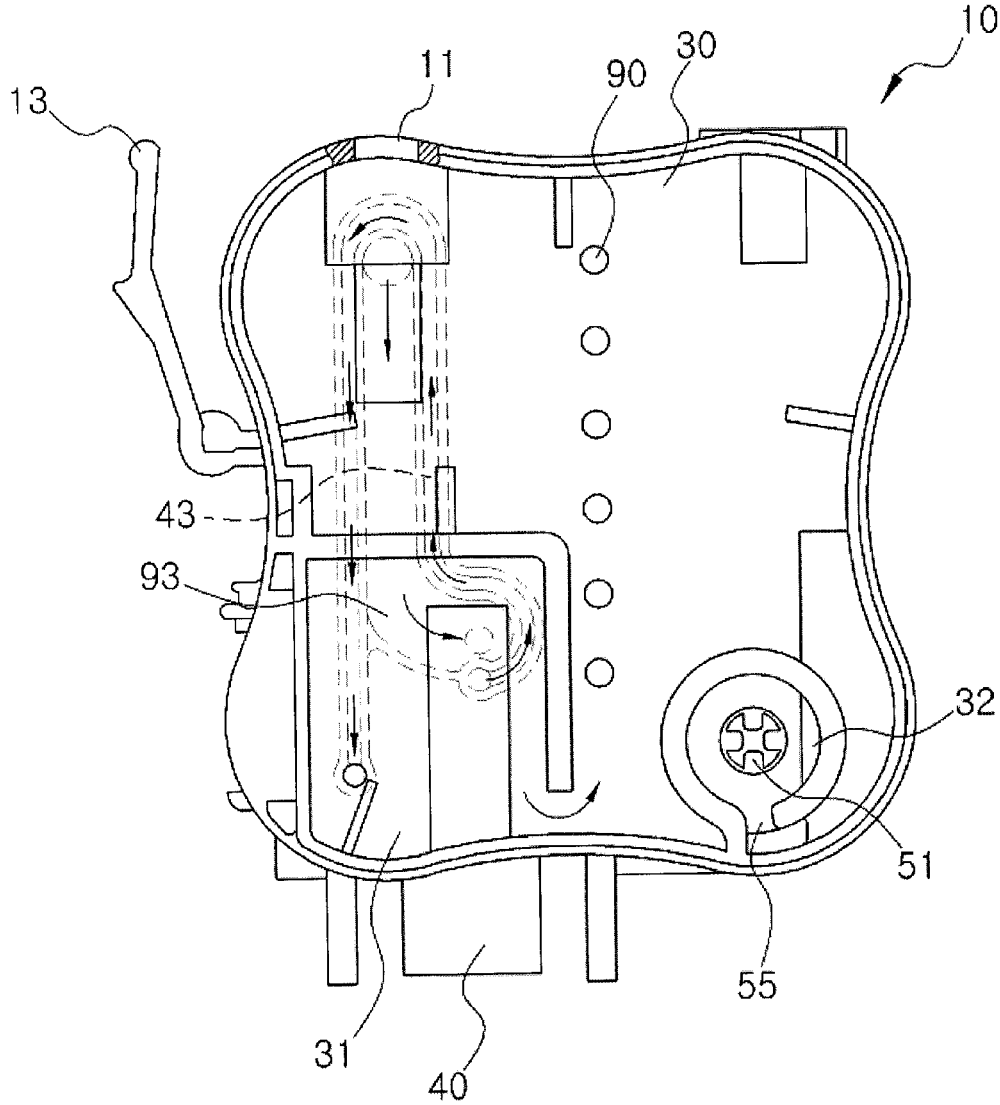

INK-CARTRIDGE FOR PRINTERS AND INK REFILLING METHOD

TECHNICAL FIELD

The present invention relates to ink cartridge for printers and ink refilling method. More particularly, the present invention relates to ink cartridge for printers and ink filling method that can expand the space where the ink is filled, and maintain pressure inside the ink cartridge.

BACKGROUND ART

Generally, printers are used as a device for outputting documents or pictures drawn up using computer on papers, and the printers include a dot matrix printer, an ink-jet printer and a laser beam printer; the ink-jet printer (100), as shown in FIG. 1, is provided with a cartridge deliverer 116 movably installed in an inside of the printer (100), and the cartridge deliverer (116) has a space into which an ink-cartridge (115) is removably mounted, a needle 118 sucking in ink filled in the ink-cartridge (115) and a head (117) injecting the ink transferred through the needle.

Although shape and structure of the ink-cartridge vary as a kind of the printer, generally the ink-cartridge, as shown in FIG. 1, has a predetermined size in order to be installed in the printer and provided with a body (110) formed with an accommodating part (130) therein and a fixing arm (113) extended from a side surface of the body (110) for fixing the body to the cartridge deliverer (116) of the printer.

Further, there is a sponge (133), where the ink is impregnated, inside the receiver (130) formed in the body (110), and an ink discharging portion (140), where the ink impregnated in the sponge (133) is discharged, is formed in the lower side of the body (110). Inside the ink discharging portion (140), a packing member (205) is installed to prevent the ink from flowing out by combining with the ink suction needle (118).

And, in the selected upper side of the body (110), a through hole (111) is formed to supply exterior air inside the body (110).

Therefore, when the printer (100) is on, documents or pictures are printed by discharging the ink from the head (117) according to the movement of the cartridge carriage (116) due to electric signal of printer controller. The continuous printing becomes possible by supplying the ink from the receiver (130) to the head (117) continuously through the ink outlet (140) and the ink suction needle (118).

However, the previous ink cartridges have the sponge (133), where the ink is impregnated, inside the body (110), so there are some problems that the space, where the ink is charged, is reduced, and the manufacturing cost becomes high by the process of installing the sponge (133) in the body (110).

To solve these problems, in the case that the sponge (133) is removed from the body (110), the ink is leaked or not well discharged by the difficulty of keeping uniform pressure inside the ink cartridge.

Also, when the ink cartridge is installed on the cartridge carriage (116) and then moved, the fine bubbles made by ink movement are discharged together with the ink to the ink discharging port (140), so the printing quality deteriorates. And, if the negative pressure is caused in some space inside the body (110) by ink movement, the ink filled in the ink suction needle (118) or the head (117) flows in the adverse direction and is not well discharged though the output signal of the printer controller, so the printing quality deteriorates.

DISCLOSURE

Technical Problem

The present invention is for solving the problems mentioned above and aims to provide the ink cartridge for printers that can expand the space where the ink is filled, and maintain pressure inside the ink cartridge, and also offset the pressure increase inside the cartridge by forming a pressure controller on one surface of the outer surface of the cartridge body where the ink is filled, in order to prevent the ink from flowing out or the printing quality from deteriorating due to temperature change an inside or an outside of the cartridge.

Additionally, it aims to provide the improved quality ink cartridge for printers by collecting air bubbles, which are made by ink movement, in a separate space and completely removing the air bubble that remains in the discharging route of ink.

It also aims to provide the ink cartridge for printers that can divide inner space into a plurality of chambers by forming more than one partition inside the body where the ink is filled and obtain excellent outputs by minimizing pressure changes inside the ink cartridge.

In addition, the present invention aims to provide the ink cartridge for printers and ink filling method that can fill the ink in the adverse direction that the ink is discharged, so that the air remaining inside the cartridge can be completely removed.

Technical Solution

To achieve all the objects above, An ink cartridge for printers comprising a body formed in a predetermined shape and having a filling hole on one surface of the body, a filling chamber where ink is filled inside the body, a discharging chamber connected to the filling chamber, an ink discharging port connected to the discharging chamber through the medium of an ink transferring channel, an air chamber connected to the filling chamber to supply air through the medium of an air transferring channel, an air suction valve installed in the air chamber, an air inducing channel that induces exterior air into the air suction valve, a blocking film attached onto one surface of the body, and a cover installed on another surface of the body, and a pressure regulating part on one surface of outer body, which communicates with the filling chamber.

The pressure regulating part, here, is communicated by the filling chamber and at least communicate. It forms some space by the blocking film and reacts flexibly to pressure change of inner and outer part of the cartridge.

Also, the present invention further comprises a bubble collector in the upper part of the ink transferring channel.

In addition, the present invention more comprises at least one partition that divides the filling chamber into a plurality of chambers.

DESCRIPTION OF DRAWINGS

FIG. 1 is a perspective view illustrating a conventional printer.

FIG. 2 is a cross-sectional view illustrating a conventional ink-cartridge.

FIG. 3 is an exploded perspective view of ink cartridge of Example 1 according to the present invention.

FIG. 4 is a cross-sectional view of ink cartridge of Example 1 according to the present invention.

FIG. 5 is a rear view of ink cartridge of Example 1 according to the present invention.

FIG. 6 is an exploded perspective view of ink cartridge of Example 2 according to the present invention.

FIG. 7 is a cross-sectional view of ink cartridge of Example 3 according to the present invention.

FIG. 8 is an exploded perspective view of ink cartridge of Example 4 according to the present invention.

FIG. 9 is a cross-sectional view of ink cartridge of Example 4 according to the present invention.

FIG. 10 is a rear view of ink cartridge of Example 4 according to the present invention.

FIG. 11 is an exploded perspective view of ink cartridge of Example 5 according to the present invention.

FIG. 12 is a cross-sectional view of ink filling method and ink flow according to the present invention.

EXPLANATION OF SYMBOLS FOR MAIN PART OF THE FIGURES

10: body
11: filling hole
12: rubber stopper
13: fixing arm
20: partition
21: connecting hole
30: filling chamber
31: discharging chamber
32: air chamber
40: ink discharging port
41: packing member
43: ink transferring channel
44: bubble collector
50: air suction valve
51: rib
55: air transferring channel
56: air inducing channel
60: blocking film
70: cover
80: pressure regulating part
90: communicating hole
93: ink injection path

BEST MODE

The present invention is described in detail based on the figures.

FIG. 3 to FIG. 5 show the ink cartridge of Example 1 according to the present invention; FIG. 3 is an exploded perspective view, FIG. 4 is a cross-sectional view, and FIG. 5 is a rear view.

As shown in FIG. 3 to 5, the present invention is An ink cartridge for printers comprising a body (10) formed in a predetermined shape and having a filling hole (11) on one surface of the body (10), a filling chamber (30) where ink is filled inside the body (10), a discharging chamber (31) connected to the filling chamber (30), an ink discharging port (40) connected to the discharging chamber (31) through the medium of an ink transferring channel (43), an air chamber (32) connected to the filling chamber (30) to supply air through the medium of an air transferring channel (55), an air suction valve (50) installed in the air chamber (32), an air inducing channel (56) that induces exterior air into the air suction valve (50), a blocking film (60) attached onto one surface of the body (10), and a cover (70) installed on another surface of the body (10), and a pressure regulating part (80) on one surface of outer body (10), which communicates with the filling chamber (30).

The inside of the body (10) has some space for specific quantity of the ink to be filled and its size and form can be changed depending on the kind of printers.

On one surface of the outer body (10), a fixing arm is made to fixate the cartridge in the head installed in printers. The space located on one side of outer surface of the body (10) is communicated with the filling chamber (30) through at least communicating hole (90) and sealed by the blocking film (60) to form the pressure regulating part (80). The pressure regulating part (80) plays a role in offsetting the pressure difference between inside and outside of the cartridge, which is caused by exterior temperature change. If excessive positive pressure or negative pressure is caused inside the cartridge due to exterior temperature change, the ink may flow through the ink discharging port (40) or contrarily, the ink may not be well discharged. In this case, the blocking film (60), which has elastic attached to the communicating hole (90) of the pressure regulating part (80), reacts to the pressure difference between inside and outside of the cartridge and flexibly expands or contracts and then naturally offsets the pressure difference and makes a balance, so that adequate quantity of the ink can be discharged through the ink discharging port (40).

In the lower part of the filling chamber (30) in the body (10), a discharging chamber (31) connected to the filling chamber (30) is made.

In the lower side of the body (10), there is an ink discharging (40) that discharges the ink to the exterior. Inside the ink discharging (40), a packing member (41) is installed to prevent the ink from flowing out by combining with the ink suction needle.

The ink discharging port (40), here, is connected to the discharging chamber (31) through the medium of an ink transferring channel (43), which is formed on one surface of outer body (10). It is desirable that the upper part of the ink transferring channel (43) should be formed near the upper part of the filling chamber (30), which makes the ink move only by suction power and prevents the ink from being excessively discharged.

In addition, an air chamber (32) is formed inside the body (10) and the air chamber and the filling chamber (30) are connected to each other through the medium of an air transferring channel (55). In air chamber (32), an air suction valve (50) is installed. For the air suction valve (50), it is desirable that a check valve opening to the single direction only should be installed for exterior air to come in and for interior ink not to be discharged. That is, the air suction valve (50) has a plurality of ribs (51) on the side of the air chamber (32); in the empty central space of the ribs (51), the air suction valve (29) is installed, which has tack-formed tips.

Also, on one surface of outer body (10), an air inducing hole (56) is formed to induce exterior air toward the air suction valve (50). It is desirable that the upper part of the air inducing channel (56) should be formed near the upper part of the filling chamber (30). The part of the air inducing channel (56) passes through the upper side of the body (10).

In one surface of the body (10), a flexible blocking film (60) is installed to block the side of the ink moving channel (43) and the air inducing channel (56). In another side of the body (10), a cover (70) is installed to block the filling chamber (30), the discharging chamber (31), and the air chamber (32).

As for the ink flow of the ink cartridge above, the ink that moves to the discharging chamber (31) through the filling chamber (30) goes toward the ink discharging port (40) along the ink transferring channel (43) by the electric sign transmitted from the printer.

The ink cartridge becomes to have lower pressure inside while the ink is being discharged due to continuous printing work, which makes the air suction valve (29) installed in the air chamber (32) becomes open and lets the air in to the ink cartridge through the air inducing channel (56), so the ink cartridge maintain the pressure uniformly.

FIG. 6 is an exploded perspective view showing the ink cartridge of Example 2 according to the present invention. Unlike the ink cartridge of FIG. 3 to 5, it more comprises a bubble collector (44), which is a specific space where air bubbles stay in the upper part of the ink transferring channel (43). The bubble collector (44) is formed in the ink transferring channel (43) connected to the ink discharging port (40), which discharges the ink. Even when there are just a few bubbles mixed in the ink from the filling chamber (30), they pass through the bubble collector (44) and they are naturally separated in the upper part of the bubble collector (44) due to density difference, so pure ink without bubbles can be supplied to the ink discharging channel (40).

FIG. 7 is a cross-sectional view of the ink cartridge of Example 3 according to the present invention. From the ink cartridge shown in FIG. 3 to 5 above, the filling chamber (30) is divided by the partition (20), which has a connecting hole (21) so that each filling chamber (30) can be communicated.

On the other hand, it is desirable that at least one partition (20) should be installed horizontally to form a plurality of filling chambers (30). Since the filling chamber (30) is divided into a plurality ones by the partition (20), when the body (10) moves with the head, the movement of the ink filled in the filling chamber (30) is minimized, which prevents fine bubbles from forming in the ink. Also, by the ink movement, the inner body (10) of the ink cartridge becomes to have negative pressure, which prevents the ink filled in the ink suction needle or head from flowing backward.

FIG. 8 to 10 show the ink cartridge of Example 4, which has different forms and sizes respectively; FIG. 8 is an exploded perspective view, FIG. 9 is a cross-sectional view, and FIG. 10 is a rear view. As long as they are in accord with the idea of the present invention, they can be applied to cartridges with various sizes and forms.

As shown in FIG. 8 to 10, the ink cartridge of other examples according to the present invention has the different size of the body (10), whose upper side has a filling hole (11) to charge the ink. After the ink is filled, the filling hole (11) is blocked by a rubber stopper (12). And on the surface of outer body (10), a fixing arm (13) is formed to generate fixing power when combined with the head installed in printers. The surface of outer body (10) is also connected to the filling chamber (30) through at least one communicating hole (90). By the blocking film (60), which is welded to the outer wall and elastic, a pressure regulating part (80) is formed, taking some space. Also, the inner space of the body (10) is divided into a plurality filling chambers (30) by the partition (20), which has the connecting hole (21) to enable each filling chamber (30) to be connected. The detailed description of the component is the same as above, so it will be omitted.

FIG. 11 is an exploded perspective view showing the ink cartridge of Example 5 according to the present invention. As represented, the present invention comprising a body (10) formed in a predetermined shape and having a filling hole (11) on one surface of the body (10), a filling chamber (30) where ink is filled inside the body (10), a discharging chamber (31) connected to the filling chamber (30), an ink discharging port (40) connected to the discharging chamber (31) through the medium of an ink transferring channel (43), an air chamber (32) connected to the filling chamber (30) to supply air through the medium of an air transferring channel (55), an air suction valve (50) installed in the air chamber (32), an air inducing channel (56) that induces exterior air into the air suction valve (50), a blocking film (60) attached onto one surface of the body (10), and a cover (70) installed on another surface of the body (10), and a pressure regulating part (80) on one surface of outer body (10), which communicates with the filling chamber (30), and the filling hole (11) connected to the ink discharging port (40) and the ink transferring channel (43) through an ink injection path (93).

FIG. 12 is a view showing the ink filling method and the ink flow according to the present invention. The ink filling method of FIG. 12 is as follows.

When the ink is filled with the filling hole (11), it firstly moves to the ink injection path (93) through the open hole in upper part of the ink injection path (93), which is communicated with the filling hole (11). Then, it goes along the ink transferring channel (43) to the discharging chamber (31) through the open hole in lower part of the ink injection path (93). The ink, now in the discharging chamber (31), moves to the filling chamber (30) and fills it. Using such ink filling method, the remaining air inside the cartridge can be completely removed, by filling the ink in the adverse direction that the ink is discharged when printing.

INDUSTRIAL APPLICABILITY

As described above, the present invention can provide the ink cartridge for printers that can expand the space where the ink is filled, and maintain pressure inside the ink cartridge, and also offset the pressure increase inside the cartridge by forming a pressure controller on one surface of the outer surface of the cartridge body where the ink is filled, in order to prevent the ink from flowing out or the printing quality from deteriorating due to temperature change inside or outside of the cartridge.

Also, the ink cartridge of the present invention improves printing quality by collecting air bubbles, which is made by ink movement, in separate space and completely removing the bubbles that remains in the discharging route of ink.

It also can provide the ink cartridge for printers that can separate inside space into a plurality chambers by forming more than one partition inside the body where the ink is filled and obtain excellent outputs by minimizing pressure changes inside the ink cartridge.

Additionally, the present invention can provide the ink cartridge for printers and ink filling method that fill the ink in the adverse direction that the ink is discharged, so that the air remaining inside the cartridge can be completely removed.

The invention claimed is:

1. An ink cartridge for printers comprising a body (10) formed in a predetermined shape and having a filling hole (11) on one surface of the body (10), a filling chamber (30) where ink is filled inside the body (10), a discharging chamber (31) connected to the filling chamber (30), an ink discharging port (40) connected to the discharging chamber (31) through the medium of an ink transferring channel (43), an air chamber (32) connected to the filling chamber (30) to supply air through the medium of an air transferring channel (55), an air suction valve (50) installed in the air chamber (32), an air inducing channel (56) that induces exterior air into the air suction valve (50), a blocking film (60) attached onto one surface of the body (10), and a cover (70) installed on another surface of the body (10), and a pressure regulating part (80) on one surface of outer body (10), which communicates with the filling chamber (30).

2. An ink cartridge for printers comprising a body (10) formed in a predetermined shape and having a filling hole (11) on one surface of the body (10), a filling chamber (30) where ink is filled inside the body (10), a discharging chamber (31) connected to the filling chamber (30), an ink discharging port (40) connected to the discharging chamber (31) through the medium of an ink transferring channel (43), an air chamber (32) connected to the filling chamber (30) to supply air through the medium of an air transferring channel (55), an air suction valve (50) installed in the air chamber (32), an air inducing channel (56) that induces exterior air into the air suction valve (50), a blocking film (60) attached onto one surface of the body (10), and a cover (70) installed on another surface of the body (10), and a pressure regulating part (80) on one surface of outer body (10), which communicates with the filling chamber (30), and the filling hole (11) connected to the ink discharging port (40) and the ink transferring channel (43) through an ink injection path (93).

3. The ink cartridge for printers of claim 1 or 2, wherein the pressure regulating part (80) is communicated with the filling chamber (30) through at least one communicating hole (90).

4. The ink cartridge for printers of claim 1 or 2, wherein the ink cartridge further comprises a bubble collector (44) in the upper part of the ink transferring channel (43).

5. The ink cartridge for printers of claim 1 or 2, wherein the filling chamber (30) is divided into a plurality of ones by at least one partition (20), which has a connecting hole (21).

6. The ink cartridge for printers of claim 1 or 2, wherein a packing member (41) is installed inside the ink discharging port (40).

7. The ink cartridge for printers of claim 1 or 2, wherein the air suction valve (50), which selectively opens and closes the air chamber (32), is a check valve that is elastically installed to open to the single direction only.

8. An ink cartridge for printers comprising a body (10) formed in a predetermined shape and having a filling hole (11) on one surface of the body (10), a filling chamber (30) where ink is filled inside the body (10), a discharging chamber (31) connected to the filling chamber (30), an ink discharging port (40) connected to the discharging chamber (31) through the medium of an ink transferring channel (43), an air chamber (32) connected to the filling chamber (30) to supply air through the medium of an air transferring channel (55), an air suction valve (50) installed in the air chamber (32), an air inducing channel (56) that induces exterior air into the air suction valve (50), a blocking film (60) attached onto one surface of the body (10), and a cover (70) installed on another surface of the body (10), and a pressure regulating part (80) on one surface of outer body (10), which communicates with the filling chamber (30), and the filling hole (11) connected to the ink discharging port (40) and the ink transferring channel (43) through an ink injection path (93), wherein the ink is filled in the adverse direction that the ink is discharged when printing.

* * * * *